United States Patent [19]

Redmond

[11] Patent Number: 4,720,014

[45] Date of Patent: Jan. 19, 1988

[54] COMPACT PACKAGE FOR SPREADABLE PRODUCTS

[76] Inventor: Sanford Redmond, 1385 York Ave., New York, N.Y. 10021

[21] Appl. No.: 729,050

[22] Filed: Apr. 30, 1985

[51] Int. Cl.[4] ..... B65D 85/00

[52] U.S. Cl. ..... 206/525; 426/130

[58] Field of Search ..... 206/471, 460, 130

[56] References Cited

U.S. PATENT DOCUMENTS

| | | | |
|---|---|---|---|
| 3,129,546 | 4/1964 | Redmond | 53/122 |
| 3,139,182 | 6/1964 | Edell | 206/471 |
| 3,209,906 | 10/1965 | Kraut | 206/471 |
| 3,442,372 | 5/1969 | Carmichael et al. | 206/471 |
| 3,676,159 | 7/1972 | Fallowfield | 206/471 |
| 4,278,693 | 7/1981 | Dingethal et al. | 206/471 |
| 4,493,574 | 1/1985 | Redmond | 401/132 |

FOREIGN PATENT DOCUMENTS

| | | | |
|---|---|---|---|
| 2307724 | 12/1976 | France | 206/471 |
| 2058708 | 8/1980 | United Kingdom | 206/471 |

*Primary Examiner*—Joseph Man-Fu Moy

*Attorney, Agent, or Firm*—Morgan & Finnegan

[57] ABSTRACT

A package for an individual service portion of a spreadable product, such as a butter pat or the like, has two opposed edges on each of the base and cover folded into a channel shape and the respective channel sides of the base and cover are positioned in overlapping abutting contact with two opposed sides of the pat to thereby encase the pat in an open-ended, generally rectangularly-shaped tubular member. Alternative structures include forming the cover from a "deadfold" foil and tamping the ends against the ends of the pat and the bottom of the base channel member to form a completely enclosed package without sealing. Also alternatively, the sides of the bottom channel may extend the full height of the pat and the top cover may be a flat sheet or may be channel-shaped perpendicular to that of the base member so as to abut the ends of the pat and form a package essentially completely enclosing the pat. Where the ends of the cover are abutted against the pat and bottom of the base channel they may be peelably glued to the base to sealingly enclose the pat. Opening means are provided to enable the sealed top to be grasped for removal.

17 Claims, 9 Drawing Figures

COMPACT PACKAGE FOR SPREADABLE PRODUCTS

RELATED PATENTS

The package for individual service portions of a spreadable product disclosed in this application represents an improvement of the package structure disclosed in the Redmond U.S. Pat. Nos. 3,129,546, issued Apr. 21, 1964 and 4,369,885, issued Jan. 25, 1983, the disclosures of which are hereby incorporated by reference.

BACKGROUND AND OBJECTS OF THE INVENTION

1. Field of the Invention

The present invention relates to a package for handling an individual service portion of a spreadable product and, more specifically, to certain new and useful improvements in the configuration and structure of such packages.

2. Description of the Prior Art

Prior to the 1960's, portioned butter (margarine was then a minimal factor in food service) was pre-packaged, sold to and used by the great majority of eating establishments in small rectangles, called "pats", generally embossed with the insignia of the producer or, in the instance of large chain consumers, with the consumer's own logo.

At that time, it was the practice of feeders such as hospitals, cafeterias, government institutions, airlines, railroads and the like, to take these butter pats and place them on small pieces of rectangular paperboard, approximately two inches square, bent upwards at a shallow angle on four sides, called butter "chips", just prior to each meal.

For example, a cafeteria whose lunch business would start around noon would assign one or more workers to place the loose butter pats on these "chips" about an hour before meal time. The cost at that time for the paperboard "chips", butter pats and labor ran on the order of five cents per pound (at present rates adjusted for inflation this might represent 20 to 30 cents per pound (a very significant number) to which could be added the cost of the packaging materials for the loose butter pats.)

In response to the need to automate the entire aforesaid process, Applicant was granted U.S. Pat. No. 3,129,546 on a machine which produced approximately 1,500 individual portion packages per minute, including forming the butter pats, placing the pats on the paperboard chips and also placing a small piece of parchment paper on the top of each pat. The paperboard chips used in the patented machine were made in an approimate two inch square and bent upwards at a shallow angle along two edges to simulate the aforesaid handmade packages. The paper covering each butter pat had the dual function of providing a degree of protection of the butter against contamination by dirt, dust or other airborne particles and, more importantly, permitted the pats to be stacked one on top of the other.

Butter pats produced by the aforesaid Redmond patented machine and in the aforesaid configuration were extremely successful and have been a staple article of commerce for a number of years. However, despite their enormous commercial success, the aforesaid packages suffered the disadvantage that they were open on four sides, permitting the passage of air about the butter, and thus could become contaminated by dirt, bacteria or the like. Also, these packages could be produced on a misadjusted machine and with inferior materials, and therefore could be of poor quality and sloppy appearance.

As a result of the aforesaid disadvantages, various alternative package structures have been produced in which the butter is completely enclosed, such as placing the butter in a cup or "tub" covered over with a foil-like top, or completely wrapping the butter in foil. However, these packages have suffered other drawbacks in that the materials from which they are made are expensive, their production is slow (on the order of 500/minute), and the equipment required for making them is expensive, unwieldy and complicated. Moreover, these packages are difficult to open and the butter is difficult to remove, invariably resulting in greasy fingers and/or wasted product.

Applicant also recently obtained U.S. Pat. No. 4,493,574 directed to a further alternative structure for providing a sealed butter pat package which also could be manufactured at the same high speed as his original package, but in which the butter pat continued to be centered on an approximate two inch square base or "chip". In this package, upon folding the cover into a three-dimensional shape a pleat is formed which extends over an edge of the base to permit the cover member to be grasped and peeled from both the margins of the base, to which it is peelably adhered, and the butter pat.

Applicant has now discovered a new and novel package structure and configuration which accomplishes a number of advantages and benefits over the aforesaid hand-made butter pat packages and Applicant's own patented automatically produced packages as well as over the various other configurations for sealed butter pat packages.

3. Objects of the Invention

It is therefore an object of this invention to provide a new and improved package for storing, shipping and handling an individual service portion of a spreadable product such as a butter pat or the like.

A further object of this invention is to provide a new and improved package for butter pats and the like which effects substantial savings in material costs, handling costs, storage costs and shipping costs over previously known package configurations for pats of butter or similar products.

A further object of this invention is to provide a new and improved package for butter pats and the like which effects substantial savings in material costs and yet results in a substantially stronger package and has greatly improved handleability and storability.

A further object of this invention is to provide a new and improved package for butter pats and the like which has a greatly improved appearance and which can only be produced with properly adjusted machinery resulting in consistency in the quality of the appearance of the packages.

A further object of this invention is to provide a new and improved package for butter pats and the like which is readily adaptable to either a partially open or essentially completely enclosed structure or to a fully enclosed package with or without sealing.

Objects and advantages of the invention are set forth in part herein and in part will be obvious herefrom, or may be learned by practice with the invention, the same being realized and attained by means of the instrumentalities and combinations pointed out in the appended claims.

The invention consists in the novel parts, constructions, arrangements, combinations, steps and improvements herein shown and described.

SUMMARY OF THE INVENTION

Briefly described, the present invention is directed to a new and improved package for storing, shipping and handling an individual service portion of a spreadable product and for supporting the spreadable product for use after removal of the cover.

As preferably embodied, the package of the present invention includes a relatively stiff base member upon which the spreadable product, such as an approximately square butter pat, is preferably approximately centered. Two opposed edges of the base are folded upwardly to form an elongated channel with the channel sides abutting against the sides of the pat and overlapping downwardly extending channel sides of an elongated and inverted channel-shaped cover formed from a relatively thin and relatively flexible sheet member cooperate to encase the pat in an elongated, open-ended, generally rectangularly shaped tubular package. Preferably, the cover is pre-folded or pre-creased into the inverted channel shape to insure the crisp and neat appearance of the finished package and there is at least one end margin on the base member extending laterally from the spreadable product.

In a preferred alternate embodiment of the invention, the cover member is formed from a "deadfold" foil material and the inverted channel ends are folded into abutment against the ends of the pat and bottom of the base channel to completely enclose the pat without glue or other adhesive.

In a further preferred alternative embodiment, the ends of the cover are peelably adhered to the bottom of the base channel to form a sealed package. As here embodied, the channel base is preferably advantageously provided with a suitable aperture which underlies the end edge of the cover, enabling the cover to be readily grasped for removal from the base and the product.

In other alternative embodiments of the invention, the sides of the bottom channel may extend the full height of the pat and the cover may be either a flat sheet, forming an elongated, open-ended tubular package, or the cover may be channel-shaped along edges perpendicular to that of the base member so as to abut the ends of the pat and thereby form a package essentially completely enclosing the pat. As a further alternative, the cover may be formed from a "deadfold" foil and the ends folded onto the ends of the pat and the bottom of the base channel, as previously described.

Also alternatively, the channel sides of the cover may overlap on the outside of the base channel sides and may be folded under the bottom of the base. Similarly, where the channel sides of the cover are perpendicular to those of the base they may be folded under the ends of the base member to form a complete enclosure along the ends of the pat.

It will be apparent from the foregoing general description that the objects of the invention specifically enumerated herein are accomplished by the invention as here embodied.

First, by reason of the configuration and shape of the new package structure of the present invention, the overall savings realized in material and handling costs is, for example, on the order of six cents per pound of butter for butter pats, which amounts to approximately a 50% reduction in the cost of these items over butter pats as presently packaged.

Thus, by forming the base of the package for a butter pat or the like into a channel whose sides abut two sides of the pat, the width of each pat package prior to forming into a channel is reduced by approximately 40% over previously known butter pat packages, resulting in an approximately 40% reduction in materials. The width of the channel-shaped base is approximately one-half that of conventional pat packages, translating into approximately the same 50% reduction in storage and transportation costs, both of which can be expensive where refrigeration is required, as in the case of butter or margarine.

Also, because both the base and cover are formed into channel-shaped configurations, additional strength and rigidity are imparted to the cover and base members and they thus may be made from thinner stock, permitting on the order of an additional 10% reduction in material cost of not only the cover and base, but also in the individual cartons in which the pats are packaged and in the shipping cases, while still ensuring that the entire shipping package has greatly increased strength and increased resistance to damage during transit over previously used packaging for butter pats.

Second, the new elongated package of the present invention has a crisp and neat appearance and, by prefolding or pre-creasing the cover into an inverted channel shape, it can be produced only with properly adjusted machinery, ensuring consistency in the quality of the product's appearance. The preferred elongated package of the invention is obtained by providing a margin on the base member extending laterally from at least one end, and preferably both ends, of the spreadable product. These margins serve the further purpose of enabling the package to be held while the cover is removed and the product scraped off, without contacting the product with either the fingers of the user or with the table top.

Third, the package of the present invention provides improved protection against dirt and airborne contamination and is readily adaptable to a fully closed package structure. Thus, even the open ended tubular configuration provides greatly increased protection for the enclosed product over the original Redmond butter pat package. In addition, the channel shape of the cover and base members contributes to the ease of mass producing packages which completely enclose the product pat. Thus, where the cover is formed from a "deadfold" foil material, the channel sides help to retain the ends of the cover against the ends of the pat and bottom of the base channel upon tamping down the ends of the cover adjacent each end of the pat.

Fourth, the provision of a channel shaped base member in the package of the present invention has the further advantage that the package remains rigid, retaining its crisp and neat appearance and is easily opened even when the contained product is soft. By contrast, completely foil wrapped butter packages lose their shape and become difficult to use when soft. Similarly, the original Redmond butter pat package is easily squashed and is then unattractive, particularly when the butter becomes soft.

It will be understood that the foregoing general description and the following detailed description as well are exemplary and explanatory of the invention but are not restrictive thereof.

The accompanying drawings, referred to herein and constituting a part hereof, illustrate preferred embodiments of the product of the present invention, and together with the description serve to explain the principles of the invention.

DESCRIPTION OF THE PREFERRED EMBODIMENTS

Figure 1:
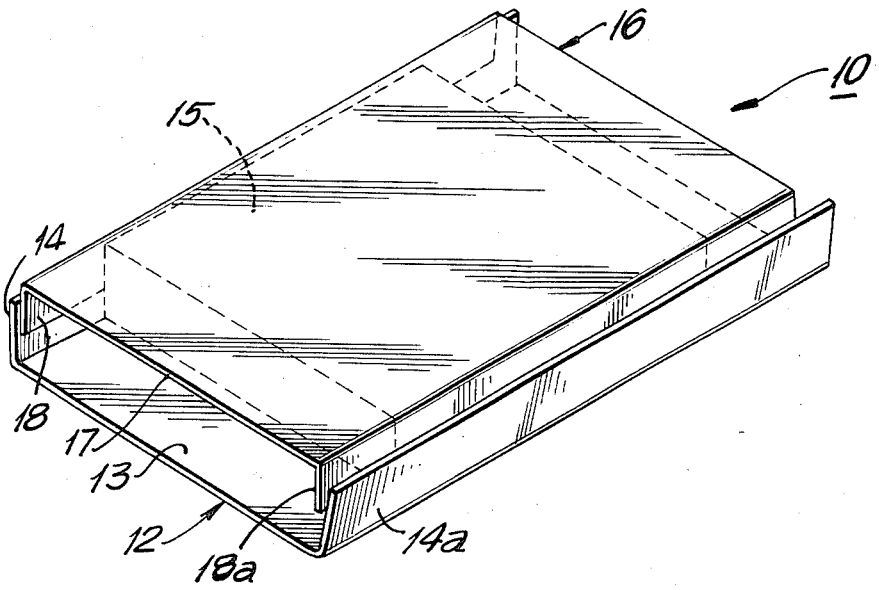
FIG. 1 is an enlarged perspective view of a package for a pat of butter constructed in accordance with a first preferred embodiment of the present invention, in which two opposed edges of each of the base and cover are folded into overlapping and abutting contact with two opposed sides of the butter pat contained therebetween to thereby encase the butter pat in a pair of open-ended channels.
Figure 2:
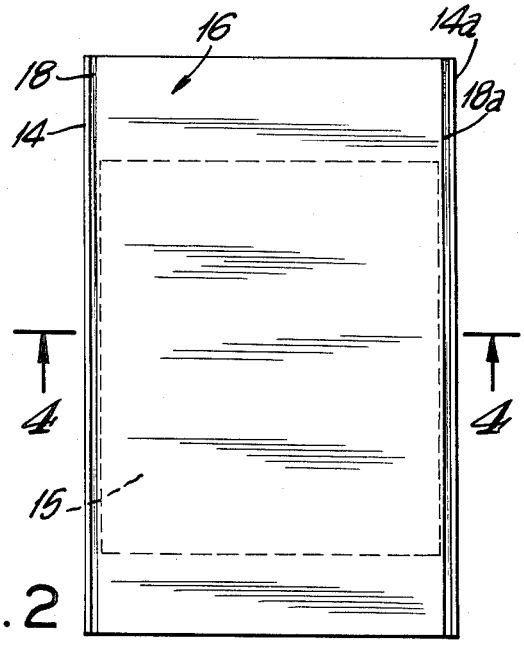
FIG. 2 is a top plan view of the package of FIG. 1.
Figure 3:
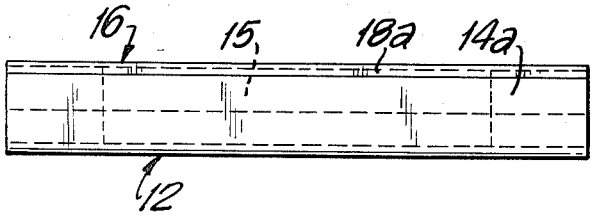
FIG. 3 is a view in side elevation of the package of FIG. 1.

Referring now more particularly to FIGS. 1–4 of the accompanying drawings, there is illustrated a first preferred embodiment of a package constructed in accordance with the present invention, indicated generally by reference numeral 10.

As here embodied, package 10 includes a relatively stiff, channel-shaped base member 12 having a flat bottom 13 and opposed side walls 14, **14*a* which abut two sides of a pat of butter or other similar product 15 preferably centrally positioned on base 12. A relatively thin cover member 16, preferably pre-creased or pre-folded, is also channel shaped and is positioned in inverted relationship to base 12 so that the bottom 17 of cover 16 rests on the top of pat 15 and its opposed channel side walls 18, 18*a* extend downwardly over and abut the sides of pat 15 in preferably approximately equal overlapping relationship with side walls 14, 14*a* of base 12**.

Advantageously, and as here preferably embodied, pat 15 is a tacky product, such as butter, margarine or peanut butter. However, it will be understood that the invention is not limited to any particular spreadable product, nor to a food product, and its application to other products will be apparent to those of ordinary skill in the art. Since the package of the invention is particularly adaptable to such usage, reference is made herein to a butter pat in order to provide an example of a practical and useful embodiment of the invention.

As preferably embodied, base member 12 is formed from a paperboard material and, advantageously, is on the order of nine mils in thickness, as compared to the normal 10.5 mil thickness for the paperboard base of conventional butter pats. However, it will be understood that other equivalent materials, such as plastics (e.g., polystyrene), which are capable of being creased or folded into a channel shape, may be used with equally satisfactory results.

Advantageously, base 12 is formed into a channel configuration by calendaring the material of the base along a line where each channel side is to be formed and thereafter folding up the outer edge of the base approximately 90° to form each of the channel sides 14, **14*a*. Alternatively, channel sides 14, 14*a* could be formed by scoring base 12** and thereafter folding up the outer edges along the score line. It has been found, however, that calendaring, which serves to compress and thereby thin the material along the line of compression, results in the formation of a stronger channel member and its application is less critical to control than scoring, and is therefore preferred.

As embodied in FIGS. 1–4, cover 16 of the present invention preferably comprises parchment paper, although other equivalent greaseproof and wet strength packaging materials are generally commercially available and may be used with equally satisfactory results. These materials may be, e.g., paper, plastic, foil, simulated foil (material printed to appear metallic) or combinations of such materials.

As here embodied, and in accordance with the present invention, pat 15 is of the conventional size of approximately one inch by one and one-quarter inch by three sixteenths inch in thickness, and base 12 has a length of approximately the conventional two inches for a butter pat but is initially only approximately one and one-quarter inch wide and, upon being formed into a channel with each channel side approximately one-eighth inch high, is thereafter approximately only one inch wide. Finally, the approximately two inch length of the base member provides an end margin of approximately three eighths inch on either end of the pat 15.

Thus, it will be seen from the foregoing that the material of the base 12 of the butter pat package of the present invention is reduced by some 40%, and the width of the finished package is reduced by approximately 50%, over previously conventional butter pat packages.

Figure 4:
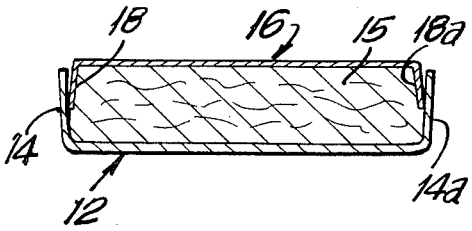
FIG. 4 is a cross sectional view taken along line 4—4 of FIG. 2.

Also, as best seen in FIGS. 1 and 4, as here embodied, base 12 and cover 16 in combination form a generally rectangularly shaped, elongated tubular package encasing the pat 15 on all but the open ends. Where pat 15 is a tacky product, such as butter or margarine, the base 12 preferably adheres to the bottom and approximate lower half of two sides of the pat and cover 16 preferably adheres to the top and approximate upper half of the aforesaid two sides of the pat, creating a unitized structure similar in principle to a "unitized" all welded automobile body, in which the chassis frame and body are welded together to provide strength and rigidity to the overall structure. Here, where the product is tacky, such as, e.g., butter or margarine, it adheres to the opposed channels formed in the cover and base, providing a compact and exceptionally strong unit.

It will be seen from the foregoing, as previously mentioned, that the resulting package provides increased protection against contamination over conventional butter pat packages. In addition, it will be understood that, by reason of the formation of the cover and base into channel-shaped members the individual package has greatly increased strength over previously known butter pat packages. When the individual packages are packed into boxes or trays and these are, in turn, packed into cases, the resulting case similarly has greatly increased strength and compactness over a case of conventional butter pat packages, resulting in greatly improved handleability and resistance to damage during shipping.

Figure 5:
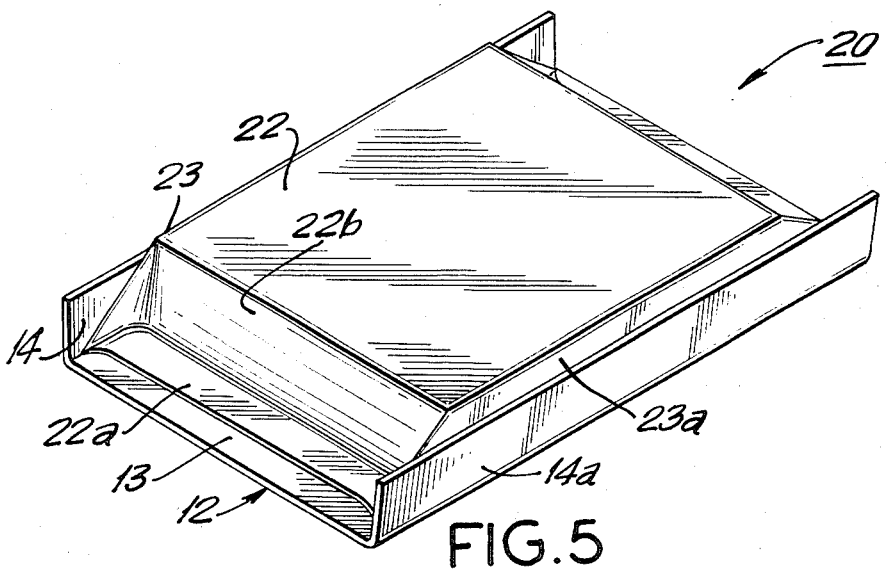
FIG. 5 is an enlarged perspective view of a package for a pat of butter constructed in accordance with a second preferred embodiment of the present invention, in which the cover is formed from a "deadfold" foil material and the ends of the inverted channel formed in the foil material are pressed into abutting contact with the two opposed ends of the butter pat contained between the foil and the bottom of the base channel to thereby form a completely enclosed package about the butter.

Referring now more particularly to FIG. 5 of the accompanying drawings, there is illustrated a preferred alternate embodiment of the invention, indicated generally by reference numeral 20.

As here embodied, cover 22 is formed from a suitable commercially available "deadfold" foil material (i.e., a foil that remains in whatever position it is folded without attempting to spring open or return to its unfolded position) such as that manufactured by the Reynolds Metals Co., Richmond, Va., and is initially creased or folded into a channel having sides 23, 23*a* which abut opposed sides of the enclosed butter pat (not shown) in overlapping relationship with the channel sides 14, 14*a* of base 12, as in the previous embodiment. The foil ends may then be formed or otherwise pressed down onto the bottom of base 12, as shown at 22*a*, to thereby cover the ends of the shown at 22*b*, and form a complete package enclosure about the pat without glue or other adhesive.

Alternatively, it will be understood that where pat 15 is a tacky product, such as butter or magarine, either cover 16 or cover 22 may be slightly shorter than shown in FIGS. 1–5 such that, upon being folded or tamped down, the ends of cover 16 or 22 abut only against the ends of the pat, terminating adjacent the bottom 13 of the base channel 12. It will be seen that, due to the tacky nature of the pat, the cover ends will adhere to the ends of the pat whether or not comprised of a deadfold foil, and thus form a completely enclosed package. While this alternative structure obtains all of the advantages of the invention previously discussed, it is not a preferred embodiment because it retains a certain amount of difficulty in removing the product from the package for use.

Also alternatively, it will be understood that the channel sides of either or both of cover 22 and base 12 may extend over the full thickness of pat 15 and therefore may overlap either partially or fully over their respective full heights. Similarly, it will be understood that the channel sides of the cover may overlap on the outside of the base channel sides, if desired.

Figure 6:
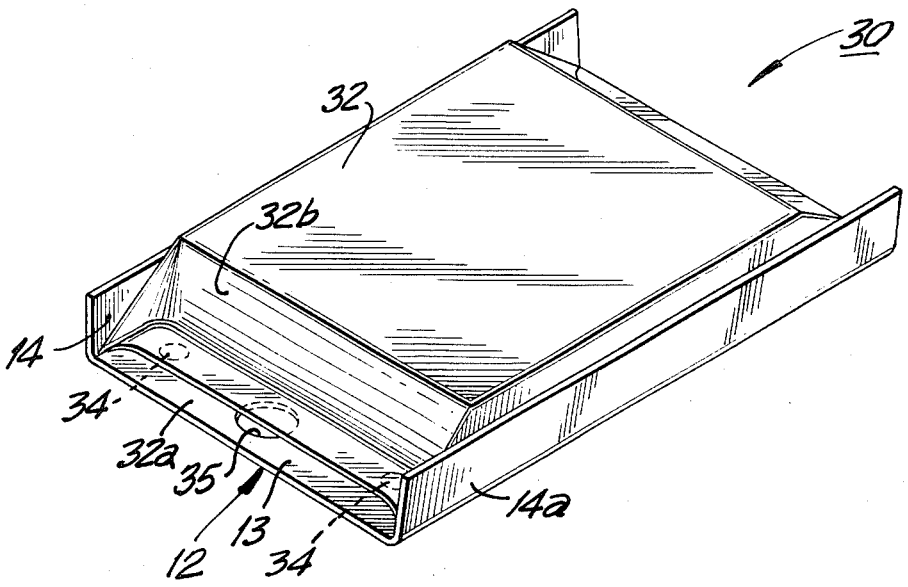
FIG. 6 is an enlarged perspective view of a third preferred embodiment of my invention which is similar to the package construction of FIG. 5, but further including the provision of dots of glue adjacent the bottom ends of the base channel member to provide a sealed package enclosure about the butter pat and an aperture in the base member underlying the edge of the cover to permit the cover to be grasped and peeled from the base member and the butter.

Referring now more particularly to FIG. 6 of the accompanying drawings, a further preferred alternate embodiment of the invention is indicated generally by reference numeral 30. As here embodied, the package is also fully enclosed except that cover 32 may, but need not be, formed from a deadfold foil and dots of a suitable adhesive 34 removably sealably adhere the ends 32*a* of cover 32 to the bottom 13 of base 12 yet permit the cover to be peelably removed therefrom.

In accordance with the invention as embodied in FIG. 6, opening means are also provided for removing sealed cover 32 for use. To this end, as here preferably embodied, an aperture 35 is provided in bottom 13 of base 12 which underlies the edge of the cover end portion 32*a* to enable the cover to be grasped and peeled from both the base and the butter or other product placed thereon.

Figure 7:
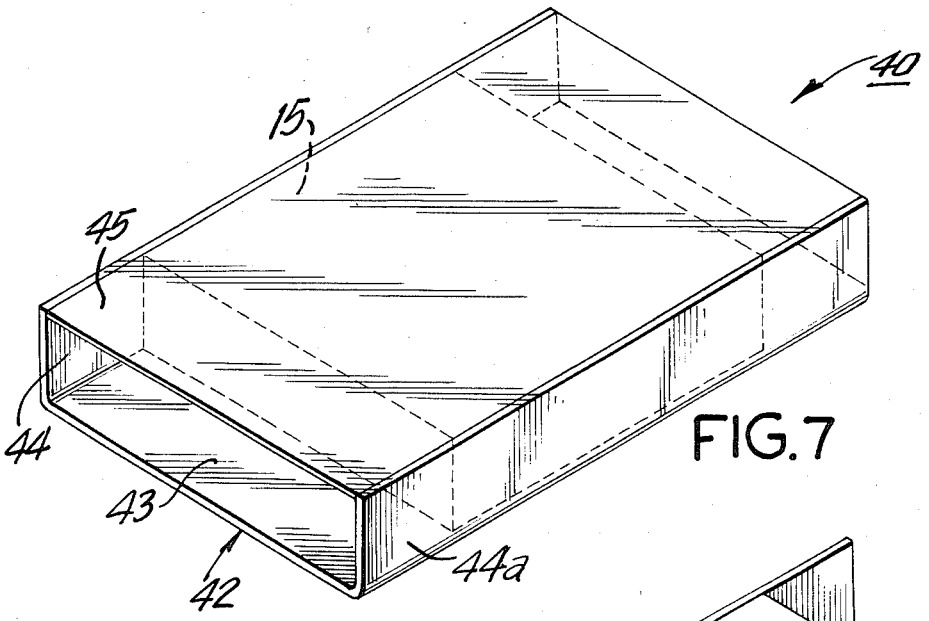
FIG. 7 is an enlarged perspective view illustrating an alternate embodiment of my invention, wherein the channel sides of the base member extend to the height of the butter pat and the cover member is flat and has a width equal to that of the butter pat.

Referring now more particularly to FIG. 7 of the accompanying drawings, there is illustrated a further alternate embodiment of a package constructed in accordance with the invention, indicated generally by reference numeral 40. As here embodied, a relatively stiff, channel-shaped base number 42 has a flat bottom 43 and opposed side walls which abut and extend the full height of the sides of the pat 15, and cover 45 is a flat sheet of approximately equal width to that of pat 15.

It will be seen that, as embodied in FIG. 7, package 40 provides essentially complete enclosure along two sides of the pat and therefore also provides increased protection against contamination over conventional butter pat packages. Package 40 also accomplishes reduced material costs and increased strength and compactness similar to that of the previous embodiments.

Figure 8:
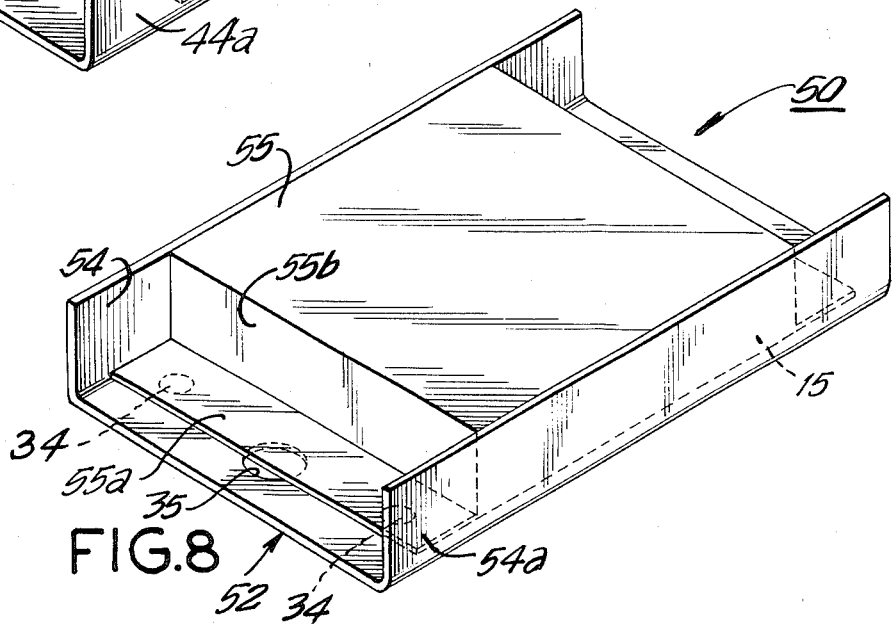
FIG. 8 is an enlarged perspective view illustrating another alternate embodiment of my invention, wherein the opposed ends of the cover opposite the channel sides of the base member are folded into abutting contact with the ends of the butter pat and sealed to the bottom of the base channel member to provide an essentially completely sealed package enclosure about the butter pat.

Referring now more particularly to FIG. 8 of the accompanying drawings, there is illustrated a further alternate embodiment of the invention at reference numeral 50. As here embodied, base 52 of package 50 is constructed similar to base 42 except that provision is made for peelably adhering the ends 55*a* of cover 55 to base 52 as in the embodiment of FIG. 6. Thus, as in the embodiment of FIG. 6, cover 55 may, but need not be, formed from a deadfold foil material. As here embodied, it will be seen that a package is provided which essentially completely encloses pat 15 and also accomplishes reduced material costs and increased strength and compactness similar to that described for the previous embodiments.

Figure 9:
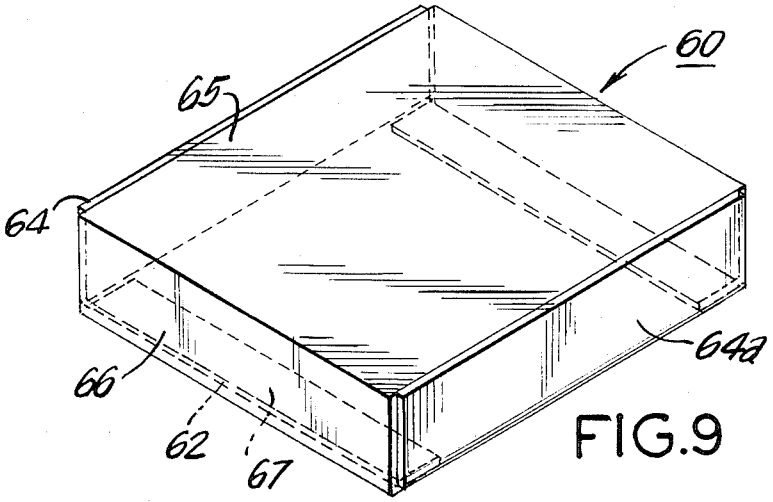
FIG. 9 is a perspective view of another alternate embodiment of my invention, similar to the construction of FIGS. 7 and 8, but wherein the end margins on the base member are removed and the cover channel sides are extended so as to be folded under the bottom ends of the base member.

Finally, referring now more particularly to FIG. 9 of the accompanying drawings, there is illustrated a still further alternate embodiment of the invention at reference numeral 60. As here embodied, base 62 of package 60 is channel-shaped similar to that of the previously illustrated embodiments, except that base 62 is approximately the same length as the enclosed pat (not shown). As here embodied, channel sides 64, 64*a* of base 62 extend approximately the height of the enclosed pat and cover 65 has a width approximately equal to the enclosed pat and channel sides of a length sufficient to cover the ends of the pat, as shown at 66, and to also be folded under the bottom of the ends of the base, as shown at 67.

It will be seen that, as embodied in FIG. 9, package 60 provides essentially complete enclosure on the sides of the spreadable product and fully encloses the product at the ends. While this package has the advantage of even further compactness of design, and obtains the same advantages of strength previously discussed, it is not preferred because it retains the difficulties in opening previously discussed and also is difficult to use without contacting the product with the fingers or table top.

To the extent not already indicated, it will be understood by those of ordinary skill in the art that any one of the various specific embodiments herein described and illustrated may be further modified to incorporate features shown or described in connection with other of the specific embodiments, as desired.

Also, while pat 15 is illustrated in a centered position on the base in each of the disclosed embodiments, which is preferred, it will be understood that the pat may be located at either end of the base channel member with satisfactory results, particularly in the embodiments illustrated in FIGS. 1–4 and 7, respectively, and in the alternative embodiment described where the cover ends terminate adjacent the bottom of the pat.

Finally, as previously mentioned, in the preferred elongated package of the invention end margins are formed on the base member which extend laterally from each end of the pat 15 on the order of three eighths of an inch. This distance is preferred because it enables the base to be held comfortably with one hand while the cover is removed and the product scraped off with the other hand. The provision on an end margin on both ends of the base also enables the product to be removed without contacting the table top, linens, etc. However, while some small margin is therefore preferred at both ends of the base, it will be understood that the invention is not limited to any specific dimension for the lateral margin.

Thus, the invention in its broader aspects is not limited to the specific embodiments herein shown and described but departures may be made therefrom within the scope of the accompanying claims, without departing from the principles of the invention and without sacrificing its chief advantages.

What is claimed is:

1. A package for storing, shipping and handling an individual service portion of a spreadable, tacky product and for supporting said spreadable, tacky product for use after opening said package, comprising: a relatively stiff, channel-shaped base member having a substantially flat bottom and opposed substantially vertically upwardly extending said walls; a spreadable, tacky product support on the bottom of said base member and by at least a portion of each of said channel side walls; and a relatively thin cover member covering at least the top of said spreadable, tacky product; each of said base channel said walls and cover member adhering to said product to thereby form a unitized package structure without the use of an adhesive material other than the packaged product.

2. A package as claimed in claim 1, wherein said channel side walls of said base member are approximately equal in height to the thickness of said spreadable, tacky product, and wherein said cover member is approximately equal in width to the width of the channel of member and the opposed ends thereof abut and are adhered to the ends of said spreadable, tacky product to thereby essentially completely enclose said spreadable, tacky product.

3. A package as claimed in claim 1, wherein said cover member is channel-shaped so as to have a substantially flat bottom and substantially vertical side walls and is positioned on said spreadable, tacky product in inverted relationship to said base member, the bottom of the cover channel covering the top of said spreadable, tacky product and the cover channel sides extending downwardly over and abutting and adhering to at least a portion of the sides of said spreadable, tacky product, the respective channel sides of said cover and said base overlapping one another to thereby enclose the spreadable, tacky product in an elongated open-ended, generally rectangularly shaped tubular package.

4. A package as claimed in claim 2, wherein said base member is elongated and has at least one end margin extending laterally of said spreadable, tacky product.

5. A package as claimed in claim 2, wherein said cover is formed from a deadfold material and said opposed cover ends abut against and adhere to the ends of said spreadable, tacky product.

6. A package as claimed in claim 2, wherein said cover ends are folded under the ends of said base member.

7. A package as claimed in claim 3, wherein said cover is pre-creased into said channel shape.

8. A package as claimed in claim 3, wherein said cover is formed from a deadfold material and said opposed cover ends abut and are adhered to the ends of said spreadable, tacky product to thereby completely enclose said product.

9. A package as claimed in claim 3, wherein said base member is elongated and has at least one end margin extending laterally of said spreadable, tacky product.

10. A package as claimed in claim 4, wherein at least one of said opposed covers ends terminates on the bottom of the base channel and is removably sealably adhered thereto.

11. A package as claimed in claim 9 wherein at least one of said opposed cover ends terminates on the bottom of the base channel and is removably sealably adhered thereto.

12. A package as claimed in claim 10 including opening means for grasping said cover member and removing it from said base member and said spreadable, tacky product.

13. A package as claimed in claim 1, wherein said spreadable, tacky product is butter.

14. A package as claimed in claim 3, wherein said spreadable, tacky product is butter.

15. A package as claimed in claim 11, including opening means for grasping said cover member and removing it from said base member and said spreadable, tacky product.

16. A package as claimed in claim 12, wherein said opening means comprises an aperture in the bottom of said base channel underlying the end edge of said cover member.

17. A package as claimed in claim 15, wherein said opening means comprises an aperture in the bottom of said base channel underlying the end edge of said cover member.

* * * * *

UNITED STATES PATENT AND TRADEMARK OFFICE

CERTIFICATE OF CORRECTION

PATENT NO. : 4,720,014

DATED : January 19, 1988

INVENTOR(S) : Sanford Redmond

It is certified that error appears in the above-identified patent and that said Letters Patent is hereby corrected as shown below:

In Column 1, line 54, "approimate" should read -- approximate --;

In Column 2, line 20, "4,493,574" should read -- 4,369,885 --;

In Column 7, line 49, after "the", second occurrence, insert -- pat, as --;

In Claim 1, line 50, "support" should read -- supported --; line 54, "said" should read -- side --;

In Claim 2, line 63, after "of" insert -- said base --;

In Claim 12, line 44, after "10" insert a comma.

Signed and Sealed this

Twenty-ninth Day of November, 1988

*Attest:*

DONALD J. QUIGG

*Attesting Officer*

*Commissioner of Patents and Trademarks*